United States Patent [19]

Reid

[11] 4,267,847

[45] May 19, 1981

[54] TOBACCO ADDITIVES

[75] Inventor: William W. Reid, London, England

[73] Assignee: British-American Tobacco Company Limited, London, England

[21] Appl. No.: 36,528

[22] Filed: May 7, 1979

[30] Foreign Application Priority Data

May 21, 1978 [GB] United Kingdom ..... 19228/78

[51] Int. Cl.[3] ..... A24B 3/12; A24B 15/24; A24B 15/30

[52] U.S. Cl. ..... 131/275; 131/298

[58] Field of Search ..... 131/143, 140 R, 142, 131/2, 17 R

[56] References Cited

U.S. PATENT DOCUMENTS 3,390,685 7/1968 Von Bethmann ..... 131/143
4,144,895 3/1979 Fiore ..... 131/143

FOREIGN PATENT DOCUMENTS 2510023 9/1975 Fed. Rep. of Germany ..... 131/143
723935 6/1972 South Africa ..... 131/143

OTHER PUBLICATIONS

*Tobacco and Tobacco Smoke* by Wynder et al., Published by Academic Press, 1967, N.Y., N.Y., pp. 351-359.

*Primary Examiner*—V. Millin
*Attorney, Agent, or Firm*—Charles R. Hoffmann

[57] ABSTRACT

A method for obtaining a smoking material additive which is a smoke-aroma precursor comprises the steps of removing surface gum, preferably surface gum only, from Nicotinia plant leaves or flowers and subjecting the gum to a partition or purification process whereby a diterpene fraction constituting the said precursor and a fraction containing undesirable lipids are obtained, the latter fraction being discarded. The gum may be removed by solvent washing, suitably with chloroform. The partition or purification step may be a two-phase solvent partition process, for example using a hexane/aqueous methanol system.

12 Claims, No Drawings

TOBACCO ADDITIVES

This invention relates to a method for providing smoking-material additives, particularly tobacco additives, which make a contribution to the aroma of the smoke, and to the additives provided as well as smoking materials incorporating the same.

Methods have been proposed for enhancing the aromatic qualities of a tobacco by treating it with substances derived from another tobacco. Thus, for instance, according to United Kingdom Patent Specification No. 638,327, a current of preheated air is passed through a body of tobacco rich in aromatic qualities and then through a body of a second tobacco. Aroma of the first tobacco is said to be entrained in the air and transferred thereby to the second tobacco.

United Kingdom Patent Specification No. 1,489,761 discloses a method of treating tobacco with the object of reducing the lipid content of the tobacco with a minimal loss of taste and aroma constituents. The tobacco is contacted with a solvent system comprising a hydrocarbon which is also a fat solvent (hexane for example) and an alkanol having 1 to 6 carbon atoms in its molecule (methanol for example). The lipids thus removed include not only surface lipids, but also internal lipids. United Kingdom Patent Specification No. 1,489,762 describes a mechanical process for removing surface lipids from tobacco leaves. It is suggested in these Specifications that lipid removal is advantageous in that lipids contribute to the generation of polycyclic aromatic hydrocarbons.

U.S. Pat. No. 3,060,172 discloses a process for extracting sclareol from clary sage, *Salvia sclarea.* From sclareol, tobacco additives may be derived which affect tobacco-smoke aroma and flavour. Dry or green sage is extracted with an aliphatic hydrocarbon (hexane for example), which results in the extraction of sclareol and some impurities. The latter are removed by introducing a lower aliphatic alcohol (aqueous methanol is given as an example), the conditions being such that the sclareol is dissolved in the alcohol phase, while a substantial percentage of the impurities are retained in the hydrocarbon phase.

The present invention seeks to provide a simple method by which effective additives can be economically obtained.

According to the invention, a method for obtaining additives which are smoke-aroma precursors comprises the steps of removing surface gum from fresh Nicotiana plant parts and subjecting the said gum to a partition or purification process whereby a precursor diterpene fraction and a fraction containing undesirable lipids are obtained, the latter fraction being discarded. Preferably, substantially only surface gum is removed from the plant parts. Advantageously, the partition or purification step is a two-phase solvent process, suitably by a known hexane and aqueous-methanol system in which the methanol represents not less than 50% by volume of the methanolic phase and is advantageously 70 to 90% thereof.

The precursor fraction may be concentrated before being applied to tobacco to enhance the aroma qualities thereof. It may, for example be added to cut tobacco by spraying, for instance at a level of 0.002–0.01% by weight.

By fresh plant parts in this Specification and the appended claims are meant plant parts which have been freshly harvested or, at least, not subjected to curing or even to such drying as will produce deleterious chemical change in the surface gums. The plant parts may be leaves, but flowers, which are a rich source of surface gum, may be employed. In carrying out the method according to the invention with tobacco leaves, it is at least highly desirable that the leaves should be fresh and substantially undried. It has been found, however, that flower gums are more stable than leaf gums and flowers can be subjected to air drying which results in the removal of up to 90% of their moisture content without the gums undergoing material chemical change. Such drying of flowers may be advantageous in that it facilitates solvent extraction of the gums. During tobacco curing, precursor diterpenes in the surface gum of tobacco plants break down so readily that unchanged diterpenes rarely exceed 0.01% of the dried weight of the cured leaf. To minimise diterpene break-down after removal of surface gum from tobacco plant parts, the gum should be processed with minimum exposure thereof to heat.

Surface gum may be removed from the plant parts by solvent washing, the solvent being, for example, chloroform or hexane. An alternative process for the gum removal is described in the aforesaid British Pat. No. 1,489,762. Whatever gum-removal process is used, it is important from a practical standpoint that surface gums only should be removed, since otherwise the surface gums must be subsequently separated from the internal gums. For this reason, it is desirable that the plant parts from which the gums are to be removed are whole plant parts with substantially intact surfaces and that the surfaces remain intact during the removal of the surface gums.

The plant parts may suitably be those of the Nicotiana species *tomentosiformis, sylvestris* or *glutinosa,* or the amphidiploid of the first two, known as the Burk Hybrid. It is also possible to use plant parts of cultivars of *N. tabacum.*

*N. tomentosiformis, N. glutinosa* and *N. sylvestris* although not providing acceptable smoking material, produce large amounts of surface gum. The surface gums of *N. tomentosiformis* and *N. glutinosa* contain labdanoid diterpenes and that of *N. sylvestris* contains thunberganoid diterpenes. The surface gum of the Burk hybrid contains labdanoid and thunberganoid diterpenes in the ratio of 1:2. By using the surface gum of the Burk hybrid in carrying out the method according to the invention, precursors of an aroma profile are obtained which our studies have shown to be similar to that of Greek and Turkish tobaccos.

EXAMPLE I

Freshly harvested green leaves of *N. sylvestris* were contacted with chloroform to extract surface gums only from the leaves. The extract was purified by partition in a two-phase hexane and aqueous-methanol system. The hexane phase, containing alkanes, esters and sterols, was discarded and the methanolic phase was concentrated in vacuo. Gum yields, recorded in three consecutive growing seasons, were 8–12% on a dry leaf basis. The solvent phase yielded 80–90% of material soluble in the methanolic phase and of this material 95% was determined as thunberganoid diterpenes.

EXAMPLE II

Trials corresponding to those of Example I were carried out using freshly harvested green leaves of *N.*

*tomentosiformis.* The gum yields were 3–6% and the solvent partition yielded 60–65% of material soluble in the methanolic phase, which material was predominantly labdanoid diterpenes. One labdanoid, cis-abienol, which partially remained in the hexane phase was recovered by a second partition.

Surface gums from the flowers of certain Oriental tobacco varieties (having a similar chemistry one to another) have been found to yield useful precursors, namely, Basma Drama, Izmir, Samsun, Samsun Bafra and Xanthi Yaka.

EXAMPLE III

Flower parts of one of these Oriental varieties in approximately 5 kg batches were loosely packed into 3 cylindrical metal vessels of capacity 5 liters each. 10 liters of chloroform was percolated through the three vessels sequentially. The initial washings were yellow and gummy, whereas the final washings were colourless and contained no diterpenes. Water was passed through the three vessels to displace residual chloroform. This chloroform was separated from water in 2 liter separating funnels. The chloroform extract (including the recovered residual chloroform) was concentrated using two rotary evaporators with 2 liter flasks and a bath temperature of 45° C. and a vacuum of 50–100 mm Hg. The evaporation proceeded rapidly to yield a lemon yellow gum. This was dissolved in 500 ml hexane and extracted with 3 portions of 80% aqueous methanol, each of 500 ml, in a 2 liter separating funnel. The hexane phase was discarded and the methanolic phase was concentrated in rotary evaporators to yield a gum-water mixture. This was dissolved in a mixture of 200 ml hexane and 100 ml absolute ethanol, and again concentrated on a rotary evaporator to yield a gum substantially free of water. The gum was stored in sealed containers in the dark at low temperatures (0.5° C.). Typically, 80–85% of the extracted surface gum partitioned into the methanolic phase. The methanolic fraction included thunberganoid diterpenes. The hexane fraction was found to contain labdanoid diterpenes. As part of a production scale process, a useful further step would therefore comprise the removal of the labdanoid diterpenes prior to the discarding of the hexane fraction.

For the application of a precursor fraction obtained as an additive to tobacco according to Example I,II or III, the said fraction, at the desired concentration in 95% ethanol, may be sprayed at a level of 0.002–0.01% by weight on to cut Virginia tobacco, which was used as the filler for cigarettes. Additives obtained as per Example II or III will impart a cedar-like note to the smoke, most noticeable in the side stream.

If required, the precursor fraction obtained by the method described in the above examples may be subjected to further purifying or refining treatment before being applied to cut tobacco.

If desired flowers may be air dried to remove a proportion of their moisture before being washed.

Oriental tobacco plants when grown for orthodox tobacco purposes are grown in poor soil and are given little irrigation and little or no fertilizer. In these conditions, the plants grow to a height of about 0.5 m. For use in accordance with the present invention, it is preferable to grow the plants with good supplies of fertilizer and water so that they grow to 1.0 to 1.5 m in height and flower prolifically.

When, for example, Basma and Izmir plants were grown in the latter conditions and at a density of 60 to 70,000 plants per hectars, it was possible to harvest two or even three crops of flowers. The total flower-gum yield was found to be 50 to 100 kg/hectars.

Two Brazilian tobacco varieties, Amarelhino and Galpão, have chemical compositions similar to the above mentioned Oriental varieties and it is to be expected that useful flower-yields could be obtained from them.

I claim:

1. A method for obtaining a smoking material additive which is a smoke-aroma precursor, which comprises the steps of removing surface gum having a diterpene fraction and a lipid fraction from fresh Nicotiana plant parts including gums and subjecting the gum to a partition or purification process whereby the diterpene fraction constituting the precursor and the fraction containing undesirable lipids are obtained, the latter fraction being discarded.

2. A method according to claim 1, wherein substantially only surface gum is removed by the gum-removal step.

3. A method according to claim 1, wherein the gum is removed by solvent washing of the plant parts.

4. A method according to claim 1, wherein the gum is removed by contacting the plant parts with chloroform.

5. A method according to claim 1, wherein the partition step comprises a two-phase solvent partition process.

6. A method according to claim 5, wherein use is made, as solvent, of a hexane aqueous methanol system.

7. A method according to claim 6, wherein the methanol represents 70 to 90% of the methanol phase.

8. A method according to claim 1, wherein the plant parts are freshly harvested leaves.

9. A method according to claim 1, wherein the plant parts are flowers.

10. A method according to claim 9, wherein the flowers are air dried to remove a proportion of their moisture.

11. A tobacco-smoke additive produced in accordance with claim 1.

12. A smoking material comprising an additive in accordance with claim 11.

* * * * *